US008172187B2

(12) United States Patent
Felknor et al.

(10) Patent No.: US 8,172,187 B2
(45) Date of Patent: May 8, 2012

(54) STAND FOR HANGING PLANTER

(75) Inventors: Wilson A. Felknor, Lenoir City, TN (US); Jim Ferron, Loudon, TN (US)

(73) Assignee: Felknor Ventures LLC, Knoxville, TN (US)

( * ) Notice: Subject to any disclaimer, the term of this patent is extended or adjusted under 35 U.S.C. 154(b) by 312 days.

(21) Appl. No.: 12/380,388

(22) Filed: Feb. 26, 2009

(65) Prior Publication Data

US 2010/0051762 A1 Mar. 4, 2010

Related U.S. Application Data

(60) Provisional application No. 61/123,773, filed on Apr. 12, 2008.

(51) Int. Cl.
*F16M 11/16* (2006.01)

(52) U.S. Cl. ..... 248/188; 248/163.1

(58) Field of Classification Search ..... 248/163.1, 248/431, 188, 188.7, 188.91; 211/107, 112, 211/196, 197, 205, 166, 172
See application file for complete search history.

(56) References Cited

U.S. PATENT DOCUMENTS

| | | | | | |
|---|---|---|---|---|---|
| 871,050 | A | * | 11/1907 | Vogt | 248/511 |
| 933,142 | A | * | 9/1909 | Vogt | 211/62 |
| 1,591,110 | A | * | 7/1926 | Willson | 248/599 |
| 3,524,616 | A | * | 8/1970 | Marschak | 248/188.7 |
| 4,032,098 | A | * | 6/1977 | Marschak | 248/165 |
| 5,615,446 | A | * | 4/1997 | Cetnarowski | 15/261 |

* cited by examiner

*Primary Examiner* — A. Joseph Wujciak, III
(74) *Attorney, Agent, or Firm* — Michael E. McKee

(57) ABSTRACT

A stand (20) from which a planter (22) can be suspended includes a hollow center post (28) having one end (48) which opens downwardly when the post is arranged substantially vertically. A plurality of openings (66) are defined about the center post, and a plurality of leg members (72) are arranged about the center post. Each of the leg members includes a foot end (76) and two post-engaging portions (94 and 84) wherein a first (94) of the post-engaging portions is accepted by a corresponding one of the openings defined about the center post and a second (84) of the post-engaging portions is accepted by the downwardly-opening end of the center post. In addition, a retainer assembly (70) cooperates between the center post and the leg members for preventing the withdrawal of the first of the post-engaging portions from the openings defined about the center post and for preventing the withdrawal of the second of the post-engaging portions from the downwardly-opening end of the center post.

27 Claims, 6 Drawing Sheets

STAND FOR HANGING PLANTER

The benefit of Provisional Application Ser. No. 61/123,773, filed Apr. 12, 2008 and entitled PLANT ASSEMBLY FOR GROWING MULTIPLE PLANTS AND ASSOCIATED IRRIGATION SYSTEM, is hereby claimed. The disclosure of this referenced provisional patent application is incorporated herein by reference.

BACKGROUND OF THE INVENTION

This invention relates generally to gardening accessories and relates, more particularly, to stands from which a planter can be hung in a suspended condition.

In our earlier U.S. Pat. No. 6,874,278, we described a planter which is adapted to be hung in a suspended condition above the ground or other underlying surface and into which a plant can be transplanted for growth. A suspended planter, such as is described in the referenced patent, is advantageous in that it enables a plant to be grown in an elevated condition above the ground (and thereby prevent the exposure of the plant, or the fruit thereof, to ground-related problems) without the need for appreciable space (e.g. ground space) for growing the plant.

It is an object of the present invention to provide a new and improved stand for supporting a planter in a suspended condition.

Another object of the present invention to provide such a stand having an improved strength for supporting a suspended planter.

Still another object of the present invention is to provide such a stand whose structure economizes material, yet imparts strength and stability to the stand during use.

Yet another object of the present invention is to provide such a stand which can be readily assembled for use and readily disassembled for storage or shipping.

A further object of the present invention is to provide such a stand whose structure accommodates a repositioning of the suspended planter in relationship with the ground or other underlying surface without requiring that the entire stand be rotated or repositioned with respect to the ground or other underlying surface.

A still further object of the present invention is to provide such a stand having legs having the capability to compensate for the unevenness of the underlying ground.

One more object of the present invention is to provide such a stand which is uncomplicated in structure, yet effective in operation.

SUMMARY OF THE INVENTION

This invention resides in a stand from which a planter can be suspended.

The stand includes an elongated hollow center post having two opposite ends and which is arrangeable in a substantially vertical orientation so that one end of the center post opens downwardly when arranged in its substantially vertical orientation. The center post also defines a plurality of openings thereabout wherein the defined openings are arranged in a common radial plane of the center post and which are spaced from the downwardly-opening end of the center post when the center post is arranged in its substantially vertical orientation.

The stand also includes a plurality of leg members for supporting the center post in its substantially vertical orientation. Each of the leg members includes a foot end for engaging the ground or underlying support surface and two post-engaging portions. A first of the two post-engaging portions is accepted by a corresponding one of the openings defined about the center post, and a second of the two post-engaging portions is accepted by the downwardly-opening end of the center post when the center post is arranged in its substantially vertical orientation.

In addition, the stand includes retaining means for cooperating between the center post and the leg members for preventing the withdrawal of the first of the post-engaging portions from the openings defined about the center post and for preventing the withdrawal of the second of the post-engaging portions from the downwardly-opening end of the center post.

DETAILED DESCRIPTION OF THE ILLUSTRATED EMBODIMENTS

Figure 1:
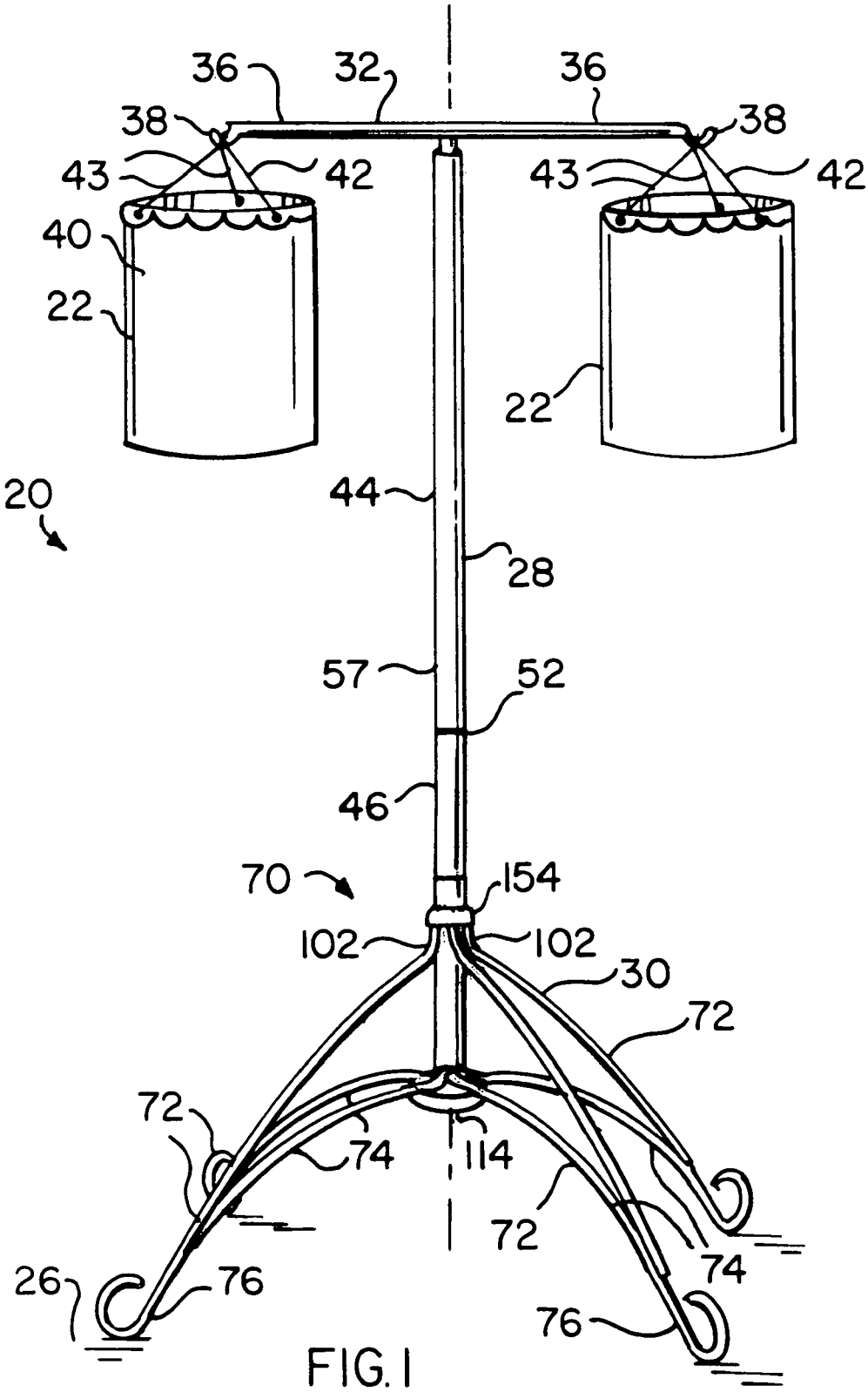
FIG. 1 is a perspective view of an embodiment of a stand within which features of the present invention are incorporated and shown utilized for supporting a pair of planters in a suspended condition.

Turning now to the drawings in greater detail and considering first FIG. 1, there is illustrated an embodiment, generally indicated 20, of a stand for supporting a pair of planters 22 in a suspended condition above the ground 26 or underlying support surface. The stand 20 includes an elongated hollow center post 28 and a leg assembly 30 for supporting the center post 28 in a substantially vertical orientation. Positioned at the top of the center post 28 is a T-shaped cross member 32 having a leg 34 which is accepted by the top of the center post 28 and having a pair of arms 36 which extend radially of the post 28 in substantially horizontal directions. At the end of the arms 36 are defined upwardly-opening crooks 38 from which the planters 22 are suspended.

Briefly, each planter 22 includes an upwardly-opening container 40 which contains dirt or potting soil in which a plant (not shown) is planted or transplanted for continued growth. Each planter 22 further includes a hanger system 42 having a plurality of cables 43 which extend between the top of the container 40 and a corresponding crook 38 defined in the arms 36.

It will be understood that the planters 22 described herein are intended to provide examples of a class of planters which can be supported by a stand embodying features of the present invention and need not take any particular form in order to be suspended from the stand 20 for use. In fact, it is envisioned that the stand 20 can be used for supporting any of several styles of planters (which can comprise, for example, a single bag which encircles the center post), hanging baskets or other items in a suspended condition above the ground. Moreover, the T-shaped cross member 32 can a form other than that described and shown herein. Accordingly, the principles of the present invention can be variously applied.

With reference to FIGS. 1-4, the center post 28 includes a pair of upper and lower hollow tubular sections 44 and 46, respectively, which are connected together in telescoping fashion to provide the center post 28 with an appreciable length (e.g. of about fifty inches). The upper tubular section 44 has two opposite lower and upper ends 52 and 54, respectively, and defines a through-opening 51 which opens out of the sides of the tubular section 44 for accepting a pin 60, described herein, and is spaced a relatively short distance from the lower end 52 (e.g. about six inches).

Figure 4:
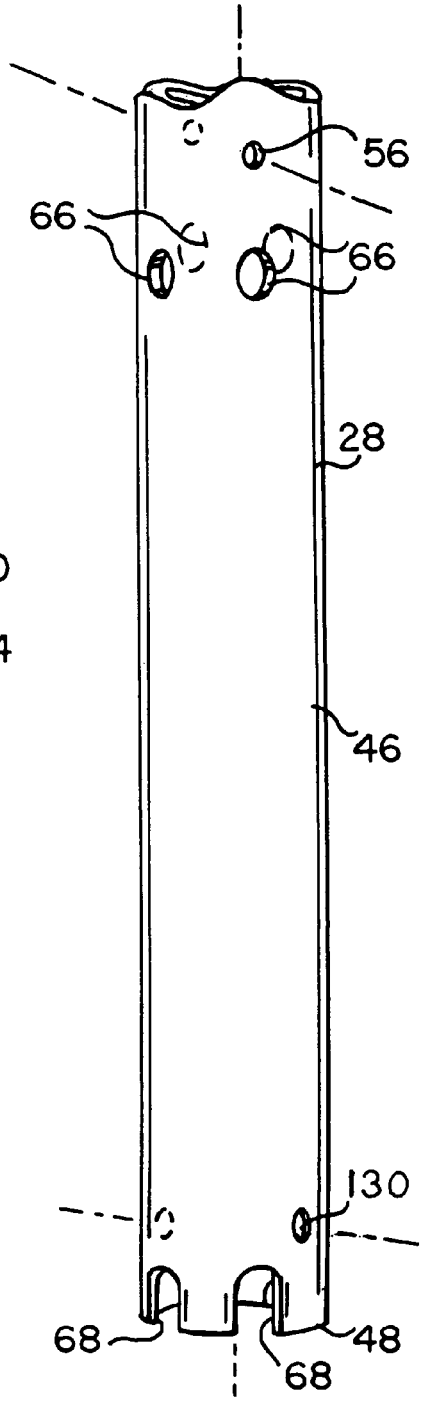
FIG. 4 is a fragmentary perspective view of the lower tubular section of the center post of FIG. 2.

The other, lower tubular section 46 has opposite lower and upper ends 48 and 50, respectively. One portion, indicated 58 in FIG. 2, of the lower tubular section 46 adjacent the upper end 50 thereof possesses a reduced diameter to permit the upper end 50 to be accepted by the lower end 52 of the upper tubular section 44 and thereby connect the tubular sections 44 and 46 together in an end-to-end relationship. In addition and as best shown in FIG. 4, the lower tubular section 46 includes a plurality of (i.e. four) openings 66 regularly spaced thereabout and disposed in a common radial (e.g. horizontally-oriented) plane of the tubular section 46, defines a through-opening 56 opening out of the sides of the tubular section 46 at locations spaced a short distance above the openings 66 for accepting a pin 57 (FIG. 7), and defines a plurality of (i.e. four) notches 68 regularly spaced about the lower end 48 thereof and which open downwardly therefrom. Each notch 68 is vertically aligned with a corresponding opening 66 defined in the lower tubular section 46 for a reason which will be apparent herein.

It is a feature of the center post 28 that when arranged in its substantially vertical orientation, its upper tubular section 44 can be rotated relative to the lower tubular section 46 with relative ease. To this end, the pivot pin 60 (introduced earlier and depicted in FIGS. 2 and 3) has a head 62 and a shank 64 which is directed shank-end first through the through-opening 51 defined adjacent the lower end 52 of the upper tubular section 44. When the lower end 52 of the upper tubular section 44 is directed downwardly over the reduced end portion 58 of the lower tubular section 46 to thereby join the tubular sections 44 and 46 together, the shank 64 of the pin 60 rests across the upper end 50 of the lower tubular section 46 so that the weight of the upper tubular section 44 and the T-shaped cross member 32 (and any planters 22 supported thereby) is transferred downwardly to the lower tubular section 46 through the pin 60. It follows that the spaced distance between the through-opening 51 and the lower end 52 of the tubular member 44 is slightly smaller than the length of the reduced end portion 58 of the lower tubular section 46 so that when the upper tubular section 44 is directed lower end-first onto the reduced end portion 58 of the lower tubular section 46, the pin 60 comes to rest across the upper end 50 of the tubular section 46 before the lower end 52 reaches the lower end of the reduced end portion 58.

Figure 3:
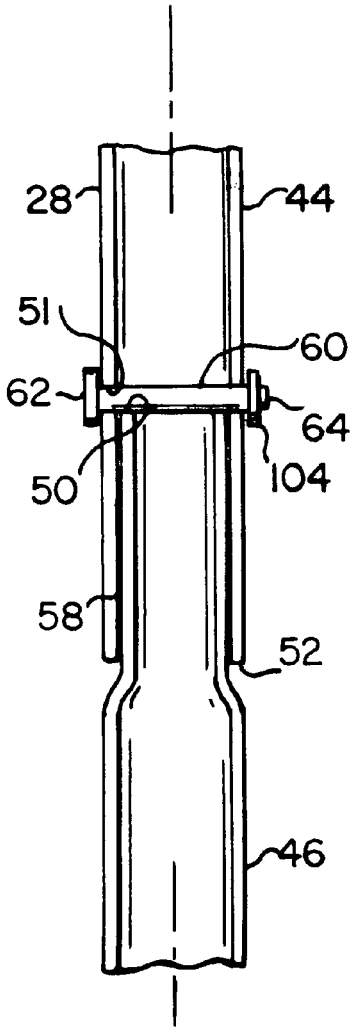
FIG. 3 is a longitudinal cross-sectional view of a fragment of the FIG. 2 center post, shown assembled.

Because of the relatively small bearing surfaces (i.e. the surfaces in contact with one another) between the surface of the pin 60 and the horizontal orientation (as seen in FIG. 3) of the plane in which the upper end 50 of the lower tubular section 46 lies, the tubular section 46 can be rotated (e.g. manually) relative to the lower tubular section 44 with relative ease. In other words, by grasping the upper tubular section 44 with the hands and rotating the tubular section 44 relative to the lower tubular section 46 about the longitudinal axis (which is arranged vertically in FIGS. 1 and 3), the pin 60 slidably moves along the surface of the upper end 50 to accommodate an adjustment in the rotational positional relationship of the upper tubular section 44 relative to the lower tubular section 46. Such a capacity is advantageous in that if it becomes necessary to alter the position of the planters 22 relative to, for example, the available sunlight, the upper tubular section 44 can be grasped and rotated relative to the lower tubular section 46 to accomplish such a purpose.

Figures 5, 6:
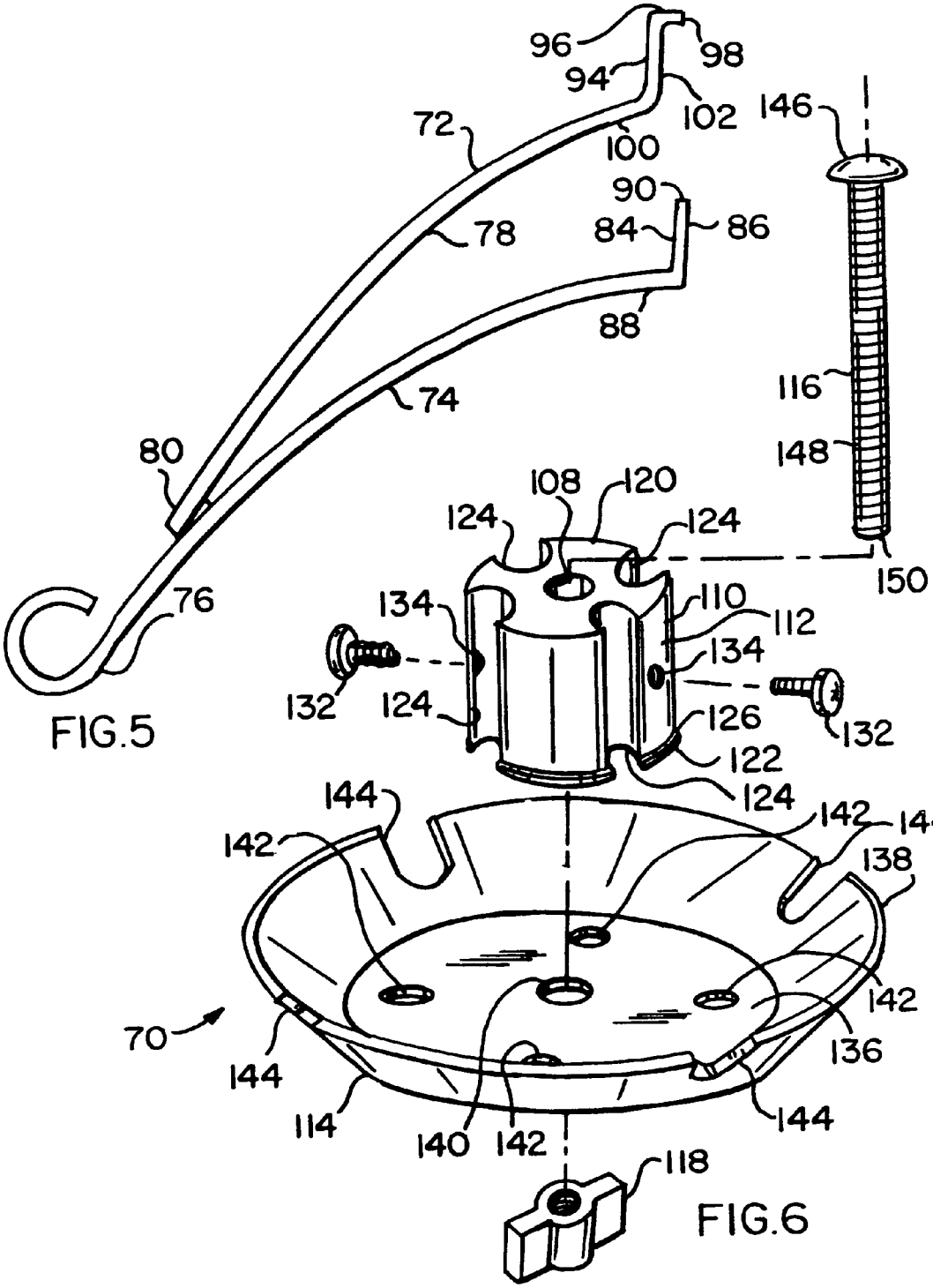
FIG. 5 is a perspective view of an exemplary leg member of the leg assembly of the FIG. 1 stand.
FIG. 6 is a perspective view of some of the components of the leg retaining means of the FIG. 1 stand, shown exploded.
Figure 7:
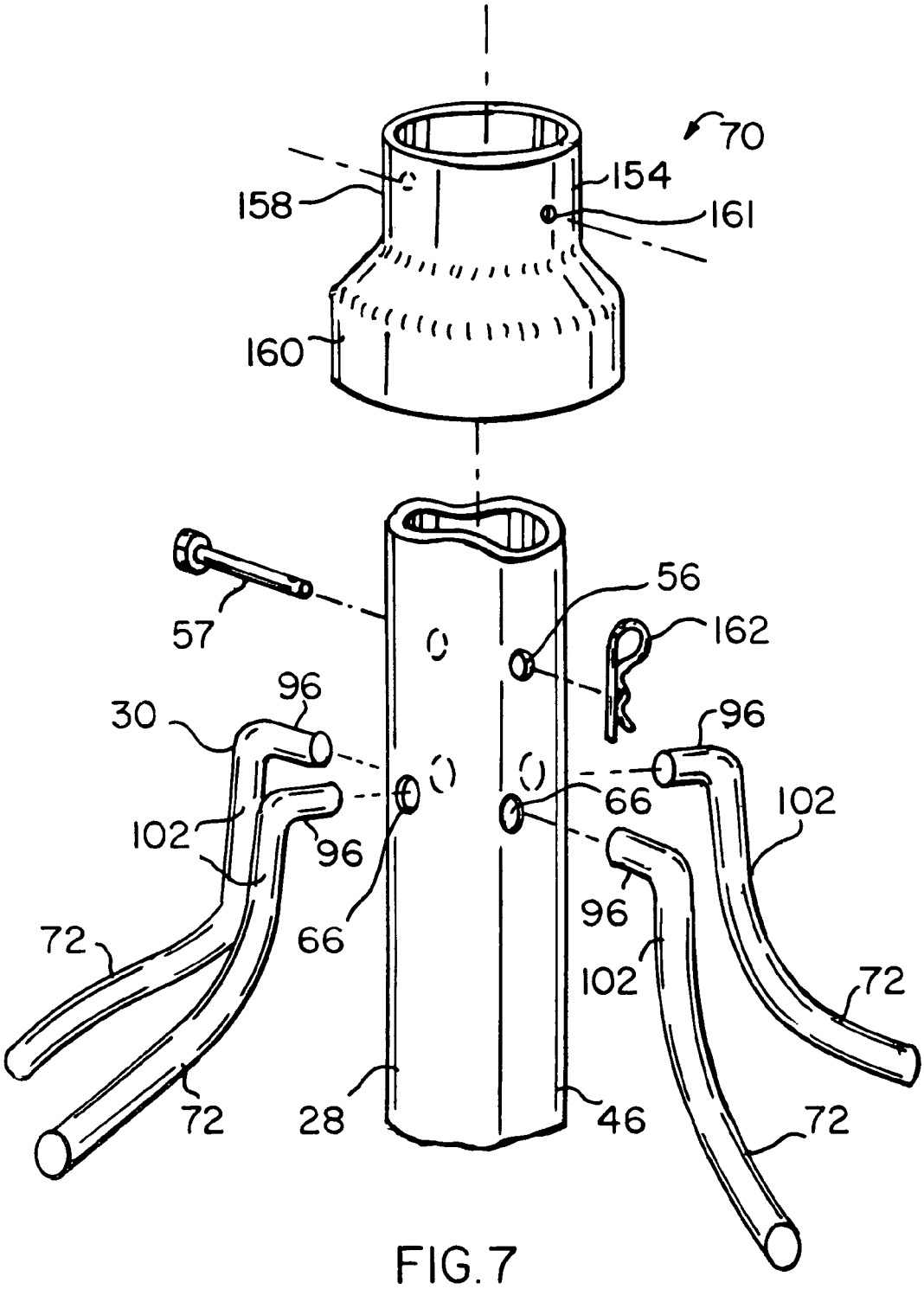
FIG. 7 is a perspective view of the remaining components of the leg retaining means of the FIG. 1 stand, shown before assembly, and a fragment of the leg members and the lower tubular section of the center post with which these remaining components are intended to cooperate.

With reference to FIGS. 5-7, the stand 20 also includes a leg retainer, or leg retaining means, generally indicated 70, for cooperating with the leg assembly 30 and the center post 28 for maintaining the assembled stand 20 in an assembled condition and so that the center post 28 is firmly and rigidly supported in a substantially vertical orientation by the leg assembly 30. In this connection and as is seen in FIG. 1, the leg assembly 30 includes a plurality (i.e. four) of identical leg members 72 regularly arranged about the lower tubular section 46 of the center post 28. As will be apparent herein and when the stand 20 is in its FIG. 1 assembled condition, the leg members 72 positioned within the openings 66 and the notches 68 defined within the lower tubular section 46, and the retaining means 70 acts between the center post 30 and the leg members 72 to prevent the leg members 72 from withdrawing from the openings 66 and the notches 68 of the lower tubular section 46.

With reference again to FIG. 5, each leg member 72 includes an elongated lower leg section 74 having a foot end 76 which is adapted to rest upon the ground or underlying support surface and having an elongated upper leg section 78 having an end 80 which is joined, as with welds, to the lower section 74 adjacent the foot end 76 thereof. Although the lower leg section 74 of the leg member 72 is curved, or arcuate, in shape along a major portion of its length, the end portion, indicated 84, of the lower leg section 74 opposite the foot end 76 is substantially L-shaped in form having one leg portion 86 which extends upwardly (as shown in FIG. 5) so as to define the corresponding end, indicated 90, of the lower leg section 74 and another leg portion 88 which extends from the leg portion 86 toward the foot end 76.

The leg portion 86 is adapted to be accepted by the lower end 48 of the lower tubular section 46 of the center post 28 in a manner described herein and when directed end 90-first upwardly therein and so that when accepted thereby, the leg portion 88 of the L-shaped end portion 84 is nestingly accepted by a corresponding notch 68 (FIG. 4) of the downwardly-opening notches 68 defined about the lower end 48 of the lower tubular section 46. As will be apparent herein, the retaining means 70 includes components (described herein) which operate to prevent the withdrawal of the L-shaped end portion 84 from the lower end 48 of the lower tubular section 46.

Furthermore and although the upper leg section 76 (FIG. 5) of the leg member 72 is curved, or arcuate, in shape along a major portion of its length, the end portion, indicated 94, of the upper leg section 78 opposite the attached (i.e. welded) end 80 is substantially L-shaped in form having one leg portion 96 which extends to one side (as shown in FIG. 5) so as to define the corresponding end, indicated 98, of the upper leg section 74 and a substantially straight leg portion 102 which extends downwardly from the leg portion 98 at a substantially right angle with respect thereto. Another (leg) portion 100 of the leg section 78 is joined to the leg portion 102 at the lower end thereof and extends therefrom toward the attached (i.e. welded) end 80 of the upper leg section 76. Furthermore, the portions 96, 100 and 102 lie in a common plane (which is oriented vertically as viewed in FIG. 5), and the portions 94 and 100 extend away from the leg portions 102 in opposite directions.

The leg portion 96 of the L-shaped end portion 94 is adapted to be accepted by a corresponding opening 66 (FIG. 4) defined in the side of the lower tubular section 46 when the leg portion 96 is inserted end 98-end first into the opening 66, and the straight leg portion 102 extends downwardly along the outer surface of the lower tubular section 46 when the leg portion 96 is accepted by the opening 66. In order to ensure that each leg member 72 is arranged in a substantially vertical plane when the stand 20 is fully assembled and positioned upon the ground so that the center post 28 is arranged substantially vertically as shown in FIG. 1, the leg portion 96 of each leg member 72 is positionable within an opening 66 which is vertically aligned with the notch 68 within which the leg portion 88 of the corresponding leg member 72 is nestingly accepted. In addition and as will be apparent herein, the retaining means 70 includes components (described herein) which operate to prevent the withdrawal of the leg portion 96 from the opening 66.

With reference to FIG. 6, there are illustrated components of the leg retaining means 70 which act to maintain the L-shaped end portions 86 of the leg members 72 in an accepted position within the lower end 48 of the lower tubular section 46. Such components include a plug 110 having a substantially cylindrically-shaped plastic body 112, a retainer, or disc, member 114, a bolt 116 and a plastic-bodied nut 118. The plug body 112 defines opposite upper and lower ends 120 and 122, respectively, a central through-opening 108 which extends between the ends 120, 122, and a plurality of (i.e. four) grooves 124 which are regularly spaced about the plug body 112 and which extend along the outer surface of the plug body 112 between the ends 120 and 122. Each groove 124 is sized to receive the upwardly-directed leg portion 86 of the lower section 74 of a corresponding leg member 72 when the leg portion 86 is inserted end 90-first upwardly into the lower end 48 of the lower tubular section 46. Furthermore, the upper end 120 of the plug body 112 is sized to be accepted by the hollow lower end 48 of the tubular section 46 when inserted upwardly and end 120-first into the lower end 48, and the lower end 122 possesses a slightly larger diameter than the upper end 120 and defines an upwardly-directed shoulder 126 therearound which provides an abutment surface for abuttingly engaging the lower end 48 of the tubular section 46 when the plug body 112 is positioned within the lower end 48.

Figure 2:
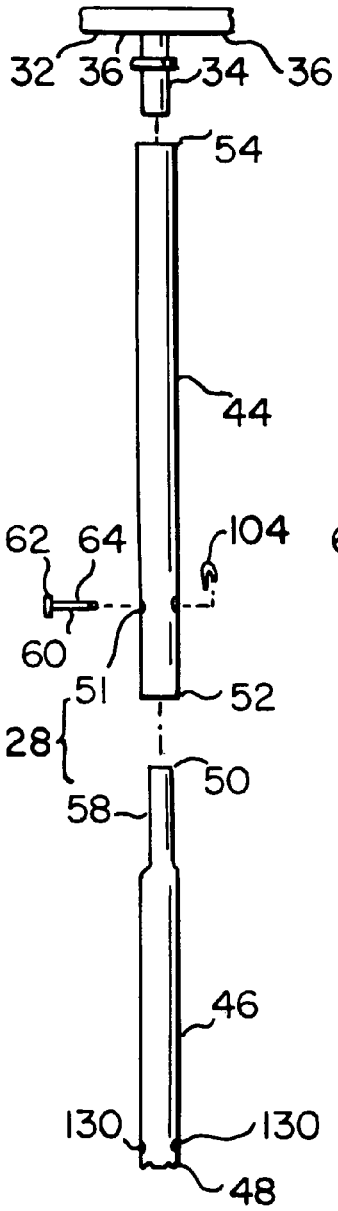
FIG. 2 is a side elevational view of the center post of the FIG. 1 stand, shown exploded.
Figure 8:
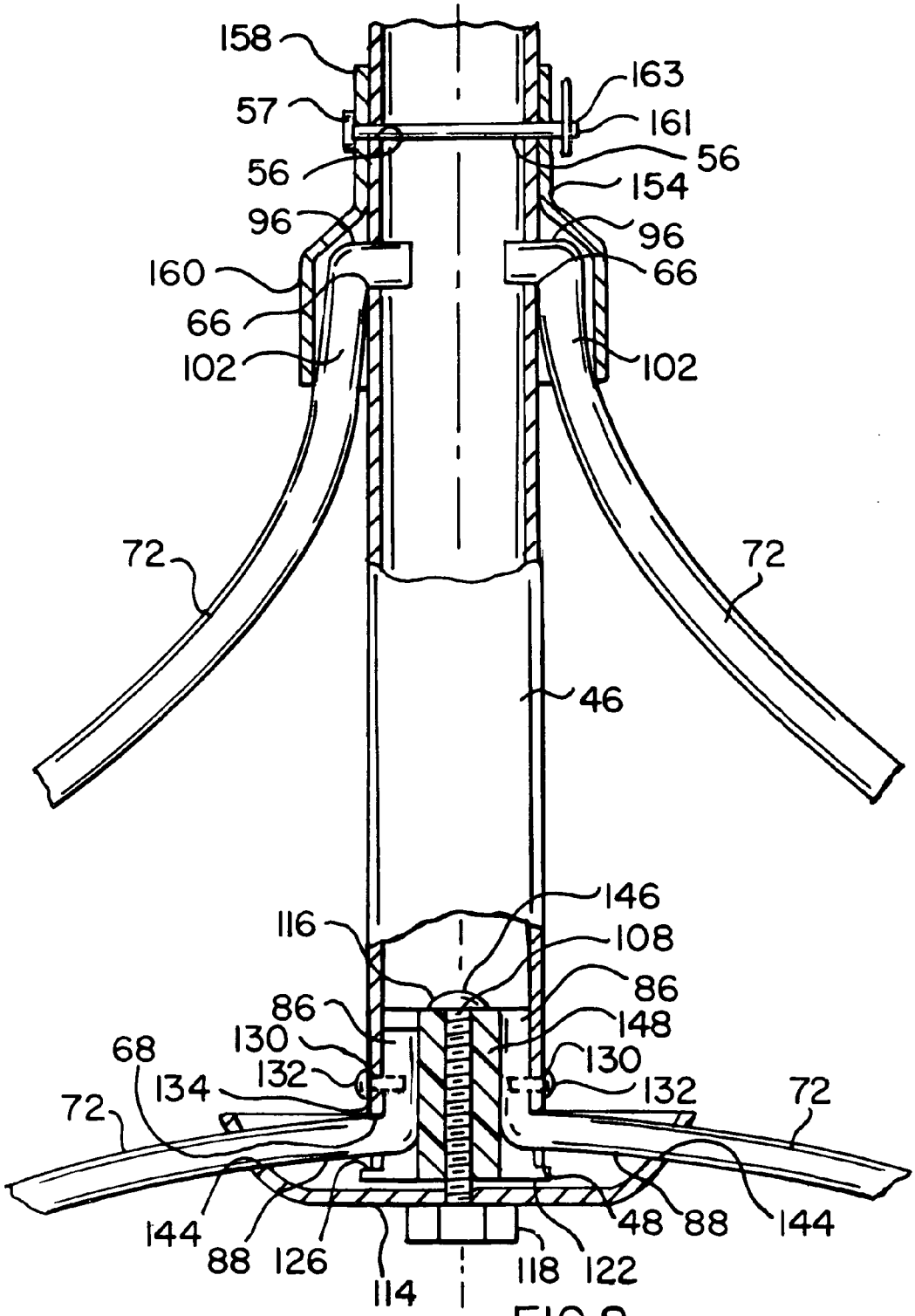
FIG. 8 is a side elevational view, shown partially in section, of a fragment of the FIG. 1 stand illustrating the cooperative relationship between the leg retaining means and the leg members of the FIG. 1 stand, when fully assembled.

As illustrated in FIGS. 2 and 8, the lower tubular section 46 of the center post 28 also includes a pair of openings 130 which are defined on diametrically-opposed sides of the tubular section 46 which permit the passage of the shanks of screws 132 (FIGS. 6 and 8) therethrough, and the plug body 112 further defines a pair of internally-threaded openings 134 in the sides thereof for threadably accepting the shanks of the screws 132. When the plug body 112 is positioned within the lower end 48 of the lower tubular section 46 so that the upwardly-directed shoulder 126 abuttingly engages the lower end 48 and so that each groove 124 is substantially aligned with a corresponding notch 68 defined along the lower end 48, the threaded openings 134 are aligned with the openings 130 of the tubular section 46 so that the screws 132 can be threadably accepted by the threaded openings 134. When the plug body 112 is positioned within the lower end 48 of the tubular section 46 in the aforedescribed manner and the screws 132 are secured within the openings 134, the plug body 112 is fixed in position along the length of the lower tubular section 46.

With reference again to FIGS. 6 and 8, the disc member 114 is substantially cup-shaped in form and includes a platen bottom portion 136 and a ring-like lip portion 138 which is joined to so as to extend angularly upwardly and away from the bottom portion 136. In addition, the bottom portion 136 defines a central through-opening 140 for accepting the shank of the bolt 116 and a plurality of (i.e. four) holes 142 which prevent the collection of water in the bottom of the disc member 114. Furthermore, there is defined along the outer edge of the lip portion 138 a plurality of (i.e. four) notches 144 which are regularly spaced about the lip portion 138 and which open outwardly of the edge of the disc member 114. Furthermore, each notch 144 is adapted to nestingly accept the leg portion 88 of a corresponding leg member 72 when the stand 20 is fully assembled. Accordingly, the width of each notch 144 is slightly larger than the diameter of a leg portion 88 of the leg member 72, and the base of each notch 144 is rounded in shape to accommodate the rounded shape of the leg portion 88 nestingly accepted by the notch 144.

The bolt 116 includes a head 146 and a shank 148 which extends from the head 146 and terminates at an end 150. The bolt 116 is insertable shank end-first into the axially-extending opening 108 provided in the plug body 112 from the upper end 120 thereof. If desired, the bolt 116 can be press-fitted within the opening 108. Positioned within the plug body 112 in this manner, the head 146 of the bolt 116 rests atop the upper end 120 of the plug body 112, and the lower end 122 of the shank 148 extends an appreciable distance out of the (lower) end 122 of the plug body 112.

During assembly of the stand 20 and with reference to FIG. 8, the bolt shank 148 is accepted by the through-opening 108 of the plug body 112 and the central through-opening 140 of the disc member 114 so that the shank end 150 extends out from beneath the disc member 114. The nut 118 is thereafter threaded upon the shank end 150 and tightened against the disc member 114 so that the disc member 114 and plug body 112 are held together between the bolt head 146 and the nut 118. As the nut 118 is tightened upon the bolt shank 148 and so that the notches 144 of the disc member 114 accept the leg portions 88 of the leg members 72, the base of each notch 144 moves into abutting relationship with the leg portion 88 before the disc member 114 contacts the lower end 122 of the plug body 112. Therefore and during assembly, the tightening of the nut 118 about the bolt 116 ensures that the disc member 114 is tightened upwardly against the leg members 72, rather than against the plug body 112, and to enhance the stability of the stand 20 when fully assembled.

With reference to FIGS. 7 and 8, the leg retaining means 70 further includes a collar member 154 which is positionable about the lower tube section 46 for movement therealong and the headed pin 156 (introduced earlier) for securing the collar member 154 in a fixed position along the length of the tubular section 46. In this connection, the collar member 154 is elongated in shape and has an upper end portion 158 and an opposite lower end portion 160 which is slightly larger in diameter than the upper end portion 158. In addition, the upper end portion 158 of the collar member 154 defines a through-opening 161 therein for accepting the shank of the pin 57 inserted therethrough. In use, the collar member 154 is positioned along the length of the lower tubular section 46 of the center post 28 so that its enlarged lower end portion 160 is positioned about and thereby encircles the straight portions 102 of the leg members 72 (which extend downwardly along the outer surface of the tubular section 46, as best illustrated in FIG. 8) while the leg portions 96 of the leg members 72 are accepted by the openings 66 provided in the tubular section 46. Accordingly, the diameter of the enlarged end portion 160 of the collar member 154 is large enough to encircle the straight leg portions 102 when positioned thereabout, and when the collar member 154 is positioned the intermediate leg portions 102 in this manner, the through-opening 160 is aligned with the through-opening 56 provided in the lower tubular section 46 of the center post 28 for receiving the shank of the pin 57. Adjacent the shank end, indicated 163, of the pin 57 opposite its head is provided an opening for accepting a cotter key 162 for securement of the pin 57 through the aligned through-openings 56 and 161.

To assemble the stand 20 and with reference to FIG. 8, bolt 116 is directed shank-end first into the central through-opening 108 of the plug body 112 from the upper end 120 thereof so that the bolt head 146 abuts the upper end 120 and the end 150 of the bolt shank 148 extends downwardly out through the lower end 122 of the plug body 112. The plug body 112 is then directed upper end-first into the lower end 48 of the lower tubular section 46 until the shoulder 126 provided at the lower end 122 of the plug body 112 is moved into abutting relationship with the lower end 48 of the tubular section 48. The plug body 112 is thereafter rotated relative to the tubular section 46, as necessary, until each threaded opening 134 of the plug body 112 is aligned with a corresponding opening 130 defined in the side of the lower tubular section 46.

At that point, the screws 132 are inserted shank end-first through the tubular section openings 130 and tightened within the threaded openings 134 of the plug body 112 to thereby secure the plug body 112 at a fixed location within (and along) the lower tubular section 46 adjacent the lower end 48 thereof. With the plug body 112 secured within the tubular section 46 in this manner, each groove 124 defined in the plug body 112 is aligned with a corresponding notch 68 defined about the lower end 48 of the tubular section 46 provides a downwardly-opening passageway for accepting the end of the leg portion 86 of the leg member 72 inserted upwardly and endwise therein.

The leg members 72 of the leg assembly 30 are thereafter joined to the lower tubular section 46 of the center post 28 by directing the leg portion 86 of each leg member 72 upwardly and endwise into a corresponding passageway provided by a groove 124 of the plug body 112 until the leg portion 88 (i.e. the upper surface thereof) of the leg member 72 abuts the upper end of the notch 68 (as best shown in FIG. 8) and by directing the leg portion 96 of each leg member 72 radially into the tubular section 46 through a corresponding opening 66 defined in a side of the tubular section 46 (as best shown in FIG. 8). At that point, the disc member 114 is positioned beneath the lower end 48 of the tubular section 46 with its lip portion 138 opening upwardly and so that the central through-opening 140 of the disc member 114 is vertically aligned with the end 150 of the bolt shank 148.

The disc member 114 is then pushed upwardly toward the lower end 48 of the tubular section 46 as it is guided along the bolt shank 148 and manipulated, as necessary, so that each notch 144 accepts a corresponding leg portion 88 of the leg members 72. The nut 118 is thereafter threaded upon the shank end 150 and tightened against the underside of the disc member 114 so that the lower leg sections 74 of the leg members 72 are tightly held between the upper ends of the notches 68 provided about the lower end 48 of the tubular section 46 and the bottom of the notches 144 provided along the lip portion 138 of the disc member 114. With the disc member 114 thereby held, or urged upwardly, against the underside of the leg portions 88 of the leg members 72 in this manner (rather than against the lower end 122 of the plug body 112), the leg portions 86 are prevented from withdrawing from the downwardly-opening passageways provided by the grooves 124 of the plug body 112 and any rotational rocking movement (as. for example, could be viewed from above the stand 20) of the leg members 72 relative to the center post 28 is resisted.

Turning attention to the upper sections 78 of the leg members 72 and with reference to FIGS. 7 and 8, the leg portions 102 of the leg members 72 each extend downwardly along the outer surface of the lower tubular section 46 while the leg portions 96 remain properly accepted by the openings 66 defined in the sides of the tubular section 46. With the leg portions 102 extending downwardly along the outer surface of the tubular section 46, the collar member 154 can be directed downwardly (enlarged end portion-first) onto the tubular section 46 by way of the upper end 50 thereof so that the enlarged end portion 160 encircles all of the leg portions 102 of the leg members 72. The collar member 154 is thereafter rotated or manipulated, as necessary, about the tubular section 46 until the pin-accepting opening 161 provided in the collar member 154 is aligned with the through-opening 56 defined in the tubular section 46. At that point, the pin 57 is directed shank-end first through the aligned openings 161 and 56 and secured through the aligned openings 161 and 56 with the cotter key 162. It follows that with the collar member 154 thereby secured along the length of the tubular section 46 so that the enlarged end portion 160 encircles the leg portions 102 of the leg members 72, the leg portions 96 of the leg members 72 are prevented from withdrawing from the openings 66 provided in the tubular section 46 and so that the upper sections 78 of the leg members 72 remain secured to the lower tubular section 46.

To ready the tubular sections 44 and 46 for attachment to one another, the pin 60 (FIG. 3) is secured within the opening 51 of the upper tubular section 44. If not already positioned in such an arrangement, the tubular section 46—with the leg assembly 30 secured thereto, is then oriented in an upright condition so that foot ends of the leg assembly 30 are positioned upon the ground 26 and so that the lower tubular section 46 is supported in a substantially vertical orientation. The upper tubular section 44 is then arranged lower end 52-down and in substantially vertical alignment above the lower tubular section 44, and the lower end 52 of the upper tubular section 44 is thereafter directed downwardly over the upper end 50 of the tubular section 44 until the pin 60 comes to rest upon the upper end 50 (as shown in FIG. 3). The leg 34 of the T-shaped cross member 32 (FIG. 2) is thereafter directed downwardly into the upper end 54 of the upper tubular section 44 to thereby connect the cross member 32 to the center post 28. At that point, the stand 20 is fully assembled, and the planters 22 can be suspended or hung from the crooks 38 provided at the ends of the arms 36 of the cross member 32.

It follows from the foregoing that a stand 20 from which a planter 22 can be suspended has been described which possesses an elongated hollow center post 28 having two opposite ends 54 and 48 and being arrangeable in a substantially vertical orientation. The end 48 of the center post 28 opens downwardly when the center post 28 is arranged in its substantially vertical orientation, and the center post 28 defines a plurality of openings 66 thereabout and which are spaced from the downwardly-opening end 48 of the center post 28 when arranged in its substantially vertical orientation. In addition, a plurality of leg members 72 are provided for supporting the center post 72 in its substantially vertical orientation wherein each of the leg members 72 includes a foot end 76 for engaging the ground 26 or underlying support surface and two post-engaging portions 94 and 84.

A first of the post-engaging portions (i.e. the portion 94) is accepted by a corresponding one of the openings 66 defined about the center post 28 and a second of the post-engaging portions (i.e. the portion 84) is accepted by the downwardly-opening end 48 of the center post 28 when the center post 28 is arranged in its substantially vertical orientation. The stand 20 further includes leg-retaining means 70 for cooperating between the center post 28 and the leg members 72 for preventing the withdrawal of the first of the post-engaging portions from the openings 66 defined about the center post 28 and for preventing the withdrawal of the second of the post-engaging portions from the downwardly-opening end 48 of the center post 28.

When assembled, the stand 20 is relatively strong and stable for hanging a planter 22 in a suspended condition therefrom, and its retaining means 70 cooperate with the leg members 72 to prevent an inadvertent collapse of the stand 20. Furthermore, the small bearing surface provided by the pin 60 against the upper end 50 of the lower tubular section 46 enables the upper tubular section 44 (and any planters 22 supported thereby) to be rotated relative to the lower tubular section 46 to accommodate an adjustment in the rotational position of the upper tubular section 44 relative to the lower tubular section 46. Further still, the stand 20 can be readily disassembled to a collapsed condition to facilitate storage or shipping of the stand 20.

Exemplary dimensions of the stand 20 and various ones of its components are provided here as follows: The outer (i.e. largest) diameter of the tubular sections 44 and 46 measures about 1.5 inches; the total length of the tubular sections 44 and 46, when joined in an end-to-end relationship, is about fifty inches; the wall thickness of the tubular sections 44 and 46 is about 0.40 inches; when supported vertically by the leg assembly 30, the upper end 54 of the center post 28 is about sixty-one inches from the underlying ground 26; and the diameter of the rods used to form each of the upper and lower sections 78, 74, respectively, of the leg members 72 is about 0.375 inches in diameter.

Figure 9:
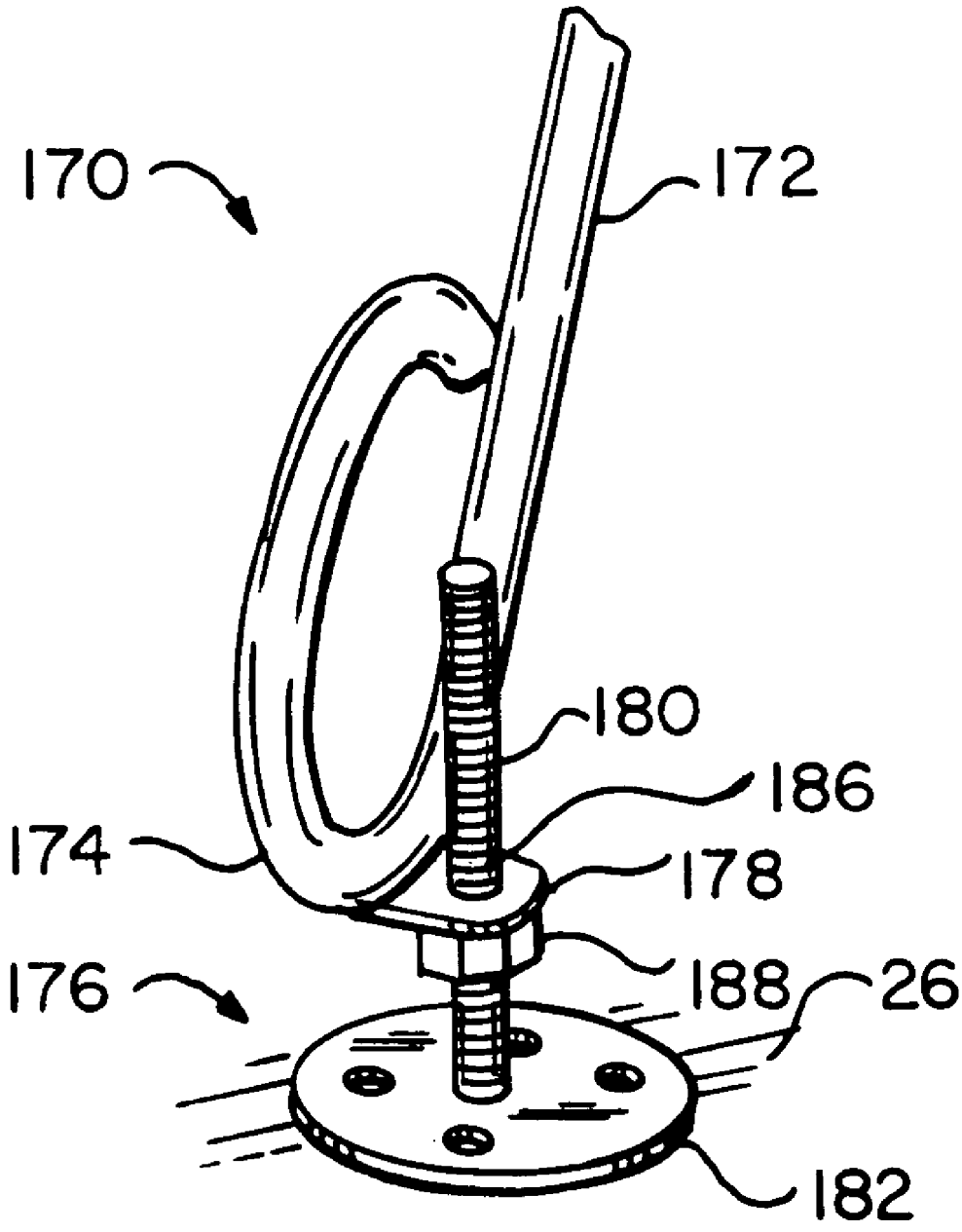
FIG. 9 is a fragmentary perspective view of a leg member of an alternative embodiment of a stand having the capacity to adjust the distance between the foot of the leg member and the underlying ground.

It will be understood that numerous modifications and substitutions can be had to the aforedescribed embodiment 20 without departing from the spirit of the invention. For example, although the aforedescribed embodiment 20 has been shown and described as including leg members 72 adapted to support the center post 28 in a substantially vertical orientation when the stand 20 is positioned upright on a substantially level (i.e. horizontally-oriented) ground, a stand in accordance with the present invention can possess means enabling the leg members to compensate for non-level or uneven ground and still support the center post of the stand in a substantially vertical orientation. For example, there is depicted in FIG. 9 a stand 170 having a leg member 172 having a foot end 174 and adjustment means, generally indicated 176, enabling a user to alter the distance between the foot end 174 and the underlying ground 26.

In connection with the foregoing, there is attached to the foot end 174 a boss member 178, a threaded shank 180 and a foot pad 182. The boss member 178 is preferably welded to the underside of the foot end 174 and has a protruding portion 184 which extends to one side of the foot end 174 which defines a vertically-opening opening 186 therein. A nut 188 (having an internally-threaded opening) is positioned against the underside of the protruding portion 184 so that its internally-threaded opening is aligned with the opening 186 therein. Positioned in such a location, the nut 188 is fixedly secured, as with welds, to the underside of the protruding portion 184.

To adjust the distance between the foot end 174 and the underlying ground 26, the threaded shank 180 is rotated (e.g. manually) relative to the nut 188 so that the foot pad 182 is moved upwardly or downwardly through the internally-threaded opening of the nut 188 and to thereby adjust, or alter, the distance between the foot pad 182 and the underside of the foot end 174. It follows that in order the leg member 172 of the stand 170 to compensate for ground beneath foot end 174 which is either higher or lower than it should be in order for the stand 170 to rest upon level ground (and thereby have its center post arranged in a substantially vertical orientation), the shank 180 is rotated relative to the nut 188 as necessary to either lengthen or reduce the distance between the foot pad 182 and the underside of the foot end 174. Accordingly, the aforedescribed embodiment 20 is intended for the purpose of illustration and not as limitation.

The invention claimed is:

1. A stand from which a planter can be suspended, the stand comprising:

an elongated hollow center post having two opposite ends and arrangeable in a substantially vertical orientation, one end of the center post opening downwardly when the center post is arranged in its substantially vertical orientation, and the center post defining a plurality of openings thereabout wherein the defined openings are arranged in a common radial plane of the center post and which are spaced from the downwardly-opening end of the center post when the center post is arranged in its substantially vertical orientation;

a plurality of leg members for supporting the center post in its substantially vertical orientation, each of the leg members including a foot end for engaging the ground or underlying support surface and two post-engaging portions, a first of the post-engaging portions adapted to be accepted by a corresponding one of the openings defined about the center post and a second of the post-engaging portions adapted to be accepted by the downwardly-opening end of the center post when the center post is arranged in its substantially vertical orientation; and a first retaining means for cooperating between the center post and the leg members for preventing the withdrawal of the first of the post-engaging portions from the openings defined about the center post and a second retaining means for preventing the withdrawal of the second of the post-engaging portions from the downwardly-opening end of the center post; and wherein the center post has an outer surface and the leg members further include sections which extend along the center post when the first of the post-engaging portions are accepted by the openings defined about the center post, and the first retaining means includes a collar member which encircles the center post and the sections of the leg members which extend along the center post when the first of the post-engaging portions are accepted by the openings defined about the center post for preventing the withdrawal of the first of the post-engaging portions from the defined openings in the center post.

2. The stand as defined in claim 1 wherein the first retaining means includes means for securing the collar member at a fixed location along the length of the center post as the collar member encircles the sections of the leg members which extend along the outer surface of the center post when the first of the post-engaging portions are accepted by the openings defined about the center post.

3. The stand as defined in claim 2 wherein the collar member defines an opening therethrough, and the first retaining means includes a pin which extends through the opening defined in the collar member for securing the collar member at a fixed location along the length of the center post.

4. The stand as defined in claim 1 wherein each of the first post-engaging portions includes an L-shaped section, one leg of each L-shaped section being received by a corresponding opening defined about the center post when directed endwise into the corresponding opening, and the other leg of each L-shaped section extends axially along the outer surface of the center post when the one leg of the L-shaped sections is received by the corresponding opening; and the collar member is positionable about the center post for acting upon the other legs of the L-shaped sections to prevent the withdrawal of the one legs of the L-shaped sections from the openings defined about the center post.

5. The stand as defined in claim 4 wherein the first retaining means further includes means for securing the collar member in a fixed position along the length of the center post when the collar member is positioned about the other legs of the L-shaped sections.

6. The stand as defined in claim 1 wherein the second retaining means includes a plug body which is securable within said one end of the center post at a fixed location therealong and provides downwardly-opening passageways for accepting the second of the two post-engaging portions of the leg members, and the second retaining means further including a retaining member which is positionable beneath the second of the two post-engaging portions of the leg members when the second of the post-engaging portions are accepted by the downwardly-opening passageways provided in the plug body, and a fastener for joining the retaining member to the plug body so that the retaining member acts upwardly against the second of the post-engaging portions of the leg members for preventing the withdrawal of the second of the post-engaging portions from the downwardly-opening passageways.

7. The stand as defined in claim 6 wherein the leg members include portions which extend radially of the center post when the second of the post-engaging portions are accepted by the downwardly-opening passageways, and the retaining member acts upwardly against the radially-directed portions of the leg members when joined to the plug body by way of the fastener.

8. The stand as defined in claim 7 wherein the fastener includes a nut and a bolt having a head and a shank, the shank extends through the plug body and the retaining member, and the nut is securable about the shank so that the plug body and the retaining member is captured between the head of the bolt and the nut.

9. The stand as defined in claim 7 wherein the second of the two post-engaging portions of each leg member is in the form of an L wherein one leg of the L-shaped form is accepted by the downwardly-opening passageway provided by the plug body when directed upwardly therein, and the other leg of the L-shaped form extends radially of the center post when the one leg is accepted by the downwardly-opening passageway and the other legs of the L-shaped form provide the radially-extending portions of the leg members.

10. The stand as defined in claim 1 wherein the second of the post-engaging portions of the leg members includes an L-shaped section, one leg of each L-shaped section being received by the hollow interior of the center post when the second post-engaging portions are accepted by the lower end of the center post, and the other leg of each L-shaped section extending substantially radially of the center post when the one leg of the L-shaped sections is received by the lower end of the center post; and the second retaining means includes a disc member which is positionable beneath the second post-engaging portions of the leg members when the second post-engaging portions are accepted by the lower end of the center post and means for attaching the disc member in a fixed position with respect to the center post so that the disc member prevents the withdrawal of the second post-engaging portions of the leg members from the downwardly-opening end of the center post.

11. The stand as defined in claim 10 wherein the means for attaching the disc member in a fixed position with respect to the center post includes a plug body which is securable in a fixed position within the interior of the center post and a shanked fastener which extends between the disc member and the plug body.

12. The stand as defined in claim 11 wherein the plug body is shaped so that when secured within the interior of the center post, the plug body provides a plurality of elongated passageways which open downwardly out of the center post for accepting the one legs of the L-shaped sections when the one legs are directed into the hollow interior of the center post.

13. The stand as defined in claim 1 wherein the second retaining means includes a collar member positionable about the first post-engaging portions of the leg members when the first post-engaging portions of the leg members are accepted by the openings defined about the center post for preventing the withdrawal of the first post-engaging portions of the leg members from the openings defined about the center post; and the second retaining means further includes a member positionable against the underside of the second post-engaging portions of the leg members and the center post when the second post-engaging portions of the leg members are accepted by the downwardly-opening end of the center post and means for securing the member against the underside of the second post-engaging portions of the leg members to thereby prevent the withdrawal of the second post-engaging portions of the leg members from the downwardly-opening end of the center post.

14. The stand as defined in claim 1 wherein the center post includes two tubular sections which are joined together in an end-to-end relationship and a pin which extends transversely through one of the two tubular sections so that when the two tubular sections are joined together in the end-to-end relationship and supported by the leg members so that the center post is arranged substantially vertically and so that the one tubular section is arranged above the other tubular section, the weight of the one tubular section is transferred onto the end of the other tubular section, and the one tubular section can be rotated relative to the other tubular section to alter the position of any planters suspended from the stand relative to the ground as the pin bears against the end of the other tubular section.

15. The stand as defined in claim 1 wherein the leg members include adjustment means for compensating for uneveness in the underlying ground so that when supported by the leg members for use of the stand, the center post is arranged substantially vertically.

16. A stand for supporting a planter in a suspended condition above the ground or underlying surface, the stand comprising:

a leg assembly; and an elongated center post being supported by the leg assembly in a substantially vertical orientation and having one end which opens downwardly when the center post is supported in a substantially vertical orientation, and the center post defining a plurality of openings thereabout wherein the defined openings are arranged in a common radial plane of the center post and which are spaced from the downwardly-opening end thereof; and the leg assembly includes a plurality of leg members arrangeable about the center post, each of the leg members including a foot end for engaging the ground or underlying surface and two post-engaging portions wherein a first of the post-engaging portions is adapted to be accepted by a corresponding one of the openings defined about the center post and a second of the post-engaging portions is adapted to be accepted by the downwardly-opening end of the center post when the center post is arranged in its substantially vertical orientation; and a first retaining means for cooperating between the center post and the leg members for preventing the withdrawal of the first of the post-engaging portions from the openings defined about the center post and a second retaining means for preventing the withdrawal of the second of the post-engaging portions from the downwardly-opening end of the center post; and wherein the center post has an outer surface and the leg members further include sections which extend along the center post when the first of the post-engaging portions are accepted by the openings defined about the center post, and the first retaining means includes a collar member which encircles the center post and the sections of the leg members which extend along the center post when the first of the post-engaging portions are accepted by the openings defined about the center post for preventing the withdrawal of the first of the post-engaging portions from the openings defined about the center post.

17. The stand as defined in claim 16 wherein the second retaining means includes a plug body which is securable within said one end of the center post at a fixed location therealong and provides downwardly-opening passageways for accepting the second of the two post-engaging portions of the leg members, and the second retaining means further including a retaining member which is positionable beneath the second of the two post-engaging portions of the leg members when the second of the post-engaging portions are accepted by the downwardly-opening passageways provided in the plug body, and a fastener for joining the retaining member to the plug body so that the member acts upwardly against the second of the post-engaging portions of the leg members for preventing the withdrawal of the second of the post-engaging portions from the downwardly-opening passageways.

18. The stand as defined in claim 16 wherein the second retaining means further includes a member positionable against the underside of the second post-engaging portions of the leg members and the center post when the second post-engaging portions of the leg members are accepted by the downwardly-opening end of the center post and means for securing the member against the underside of the second post-engaging portions of the leg members to thereby prevent the withdrawal of the second post-engaging portions of the leg members from the downwardly-opening end of the center post.

19. A stand from which a planter can be suspended, the stand comprising:

an elongated hollow center post having two opposite ends and arrangeable in a substantially vertical orientation, one end of the center post opening downwardly when the center post is arranged in its substantially vertical orientation, and the center post defining a plurality of openings thereabout wherein the defined openings are arranged in a common radial plane of the center post and which are spaced from the downwardly-opening end of the center post when the center post is arranged in its substantially vertical orientation;

a plurality of leg members for supporting the center post in its substantially vertical orientation, each of the leg members including a foot end for engaging the ground or underlying support surface and two post-engaging portions, a first of the post-engaging portions adapted to be accepted by a corresponding one of the openings defined about the center post and a second of the post-engaging portions adapted to be accepted by the downwardly-opening end of the center post when the center post is arranged in its substantially vertical orientation; and a first retainer that prevents the withdrawal of the first of the post-engaging portions from the openings defined about the center post and a second retainer that prevents the withdrawal of the second of the post-engaging portions from the downwardly-opening end of the center post; and wherein the second retainer includes a plug body which is securable within said one end of the center post at a fixed location therealong and provides downwardly-opening passageways for accepting the second of the two post-engaging portions of the leg members, and the second retainer further includes a retaining member which is positionable beneath the second of the two post-engaging portions of the leg members when the second of the post-engaging portions are accepted by the downwardly-opening passageways provided in the plug body, and a fastener for joining the retaining member to the plug body so that the retaining member acts upwardly against the second of the post-engaging portions of the leg members for preventing the withdrawal of the second of the post-engaging portions from the downwardly-opening passageways.

20. The stand as defined in claim 19 wherein the center post has an outer surface and the leg members further include sections which extend along the center post when the first of the post-engaging portions are accepted by the openings defined about the center post, and the first retainer includes a collar member which encircles the center post and the sections of the leg members which extend along the center post when the first of the post-engaging portions are accepted by the openings defined about the center post so that the withdrawal of the first of the post-engaging portions from the defined openings in the center post is prevented by the collar member.

21. The stand as defined in claim 19 wherein each of the first post-engaging portions includes an L-shaped section, one leg of each L-shaped section being received by a corresponding opening defined about the center post when directed endwise into the corresponding opening, and the other leg of each L-shaped section extends axially along the outer surface of the center post when the one leg of the L-shaped sections is received by the corresponding opening; and the first retainer includes a collar member which is positionable about the center post for acting upon the other legs of the L-shaped sections to prevent the withdrawal of the one legs of the L-shaped sections from the openings defined about the center post.

22. The stand as defined in claim 19 wherein the leg members include portions which extend radially of the center post when the second of the post-engaging portions are accepted by the downwardly-opening passageways, and the retaining member acts upwardly against the radially-directed portions of the leg members when joined to the plug body by way of the fastener.

23. The stand as defined in claim 22 wherein the fastener includes a nut and a bolt having a head and a shank, the shank extends through the plug body and the retaining member, and the nut is securable about the shank so that the body and the retaining member are captured between the head of the bolt and the nut.

24. The stand as defined in claim 23 wherein the second of the two post-engaging portions of each leg member is in the form of an L wherein one leg of the L-shaped form is accepted by the downwardly-opening passageway provided by the plug body when directed upwardly therein, and the other leg of the L-shaped form extends radially of the center post when the one leg is accepted by the downwardly-opening passageway and the other legs of the L-shaped form provides the radially-extending portions of the leg members.

25. The stand as defined in claim 19 wherein the second of the post-engaging portions of the leg members includes an L-shaped section, one leg of each L-shaped section being received by the hollow interior of the center post when the second post-engaging portions are accepted by the lower end of the center post, and the other leg of each L-shaped section extending substantially radially of the center post when the one leg of the L-shaped sections is received by the lower end of the center post; and the retaining member includes a disc member which is positionable beneath the second post-engaging portions of the leg members when the second post-engaging portions are accepted by the lower end of the center post and an assembly that attaches the disc member in a fixed position with respect to the center post so that the disc member prevents the withdrawal of the second post-engaging portions of the leg members from the downwardly-opening end of the center post.

26. The stand as defined in claim 25 wherein the assembly that attaches the disc member in a fixed position with respect to the center post cooperates with the plug body of the second retainer which is securable in a fixed position within the interior of the center post and includes a shanked fastener which extends between the disc member and the plug body.

27. The stand as defined in claim 26 wherein the plug body is shaped so that when secured within the interior of the center post, the downwardly-opening passages of the plug body are provided by a plurality of elongated passageways which open downwardly out of the center post for accepting the one legs of the L-shaped sections when the one legs are directed into the hollow interior of the center post.

* * * * *